US006789311B2

(12) United States Patent
Fidi et al.

(10) Patent No.: US 6,789,311 B2
(45) Date of Patent: Sep. 14, 2004

(54) METHOD OF MANUFACTURING A LACQUER COATED WIRE

(75) Inventors: Werner Fidi, Baden (AT); Hugo Lenhard-Backhaus, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 0 days.

(21) Appl. No.: 10/244,050

(22) Filed: Sep. 13, 2002

(65) Prior Publication Data

US 2003/0054192 A1 Mar. 20, 2003

(30) Foreign Application Priority Data

Sep. 19, 2001 (AT) ..... 1492/2001

(51) Int. Cl.[7] ..... H01R 43/00

(52) U.S. Cl. ..... 29/825; 29/828; 29/868; 29/869; 29/605

(58) Field of Search ..... 29/868, 869, 828, 29/825, 605; 72/211, 224; 174/129 R, 133 R

(56) References Cited

U.S. PATENT DOCUMENTS 3,815,069 A * 6/1974 Palazzetti et al. ..... 336/200
5,171,942 A * 12/1992 Powers ..... 174/129 R
5,725,953 A * 3/1998 Onishi et al. ..... 428/383
5,744,756 A * 4/1998 Springer et al. ..... 174/110 N
5,998,027 A * 12/1999 Onishi et al. ..... 428/379

* cited by examiner

*Primary Examiner*—Carl J. Arbes
*Assistant Examiner*—Tai Nguyen
(74) *Attorney, Agent, or Firm*—Friedrich Kueffner

(57) ABSTRACT

A method of manufacturing a wire includes pressing a lacquer-coated wire having a round cross-section into a wire having a long cross-sectional axis and a short cross-sectional axis, wherein the ratio of the axes is at most 3:1.

3 Claims, 2 Drawing Sheets

METHOD OF MANUFACTURING A LACQUER COATED WIRE

BACKGROUND OF THE INVENTION

1. Field of the Invention

The present invention relates to a lacquer-coated wire with a noncircular cross-section having two axes of different lengths and extending perpendicularly to each other. The wire is composed of a metal wire and a lacquer coating surrounding the metal wire, wherein the lacquer coating has insulating and baked enamel properties; the lacquer-coated wire is intended particularly for manufacturing electrical coils. The present invention is also directed to a method of manufacturing the wire.

2. Description of the Related Art

Lacquer-coated wires having a round cross-section for manufacturing electrical coils are known in the art. These wires are composed of copper, aluminum or another metal or a metal alloy and have an inner electrically insulating coating and an outer baked lacquer or baked enamel layer on the inner coating. The first inner lacquer coating, which is composed of polyurethane or polyesteramid, serves for the electrical insulation of the wire. The second outer lacquer layer, also called baked enamel, serves for mechanically connecting the windings and the winding layers. The outer layer is composed of lacquers which make a subsequent softening of the lacquer layer possible. The lacquer layer can be softened either by the influence of heat or by the influence of a chemical solvent. Usually used are lacquers on the basis of polyvinyl butyral or polyamid.

In the following description, the term "round" is always understood to mean "circular", while "noncircular" means that it deviates from the exact circular cross-section. The noncircular cross-sections are essentially oval and rectangular cross-sections, wherein the latter have rounded edges; thus, as defined above, the noncircular cross-sections have two axes of different lengths which extend perpendicularly to each other.

Wires of the above-described type are used for the manufacture of electrical, self-supporting coils. However, these coils with a wire having a round cross-section have the disadvantage that free spaces remain between adjacent wires. These spaces reduce the packing density which reduces the efficiency of the device in which the coil is being used. In addition, the individual wires of such coils only contact each other along very narrow contact lines, so that, also because such coils are subjected to electromechanical forces, the durability of such coils is impaired.

In the attempt to obtain more densely packed coils, it is also known in the art to manufacture the coils of lacquer-coated wires with rectangular cross-sections. Wires of this kind are obtained by deforming the metal core as necessary and subsequently providing the core with the insulating layers.

However, the coated wires with a metal core of rectangular cross-section have the disadvantage that, as a result of the manufacturing method, the coatings are not applied with uniform thickness on the metal core. The reason for this is the lacking symmetry of the rectangular metal wire in connection with the surface stress of the material of the coatings. For this reason, such wires have coatings with convex outer surfaces. When coils are manufactured from these wires, adjacent wires also only contact each other along relatively narrow contact lines, wherein, as is the case in coils manufactured from wires of round cross-section, intermediate spaces remain between the individual wires. Since the lacquer coating and, thus, also the outer baked enamel layer on the wire are applied with different thicknesses over the rectangle surfaces, and since the wires bake together only over relatively narrow contact areas, the adherence between individual wires in the coil is not optimal. This, in turn, significantly reduces the service life and the mechanical self-supporting capability of the coil.

SUMMARY OF THE INVENTION

Therefore, it is the primary object of the present invention to provide a noncircular lacquer-coated wire which does not have the disadvantages of the wires described above.

In accordance with the present invention, the wire has a lacquer coating which is composed in the conventional manner of an inner electrically insulating lacquer layer and an outer baked lacquer layer, wherein, in accordance with the present invention, the lacquer layer on the sides to be assigned to the longer cross-sectional axis have a smaller thickness than the sides to be assigned to the shorter cross-sectional axis.

In accordance with an alternative embodiment of the present invention, the metal wire is surrounded by a single lacquer layer which has the insulating properties as well as the baked lacquer properties. As a side to be assigned to a particular cross-sectional axis is the area of the surface which can be considered most closely to extend parallel to that cross-sectional axis.

In accordance with an advantageous further development of the invention, the wire has a cross-section with an axis ratio of at most 3:1, wherein the cross-section is rectangular or, in accordance with an advantageous feature, oval.

The advantage of such a wire according to the present invention is that its configuration makes it possible to manufacture an electrical coil in which adjacent wires are placed closely against each other and bake together over a large surface area. Due to the fact that the lacquer thickness of the lacquer coating of the wire is thicker, preferably, significantly thicker at the sides to be assigned to the shorter cross-sectional axis than at the sides to be assigned to the longer cross-sectional axis, it is possible when manufacturing coils of lacquer-coated wires with particularly an oval cross-section to substantially fill out with lacquer coating material the spaces which result when the wires are arranged next to one another. This is because the coil manufacture takes place by heating so that the lacquer-coating material becomes plastic and particularly the spaces formed in the areas of the sides to be assigned to the shorter cross-sectional axis of the wire can be filled out with lacquer coating material which becomes available to an increased extent at this location. The essentially uniform thickness of the lacquer coating at all sides or surfaces of the wire according to the present invention ensures a close arrangement and baking together of the lacquer-coated wires having rectangular cross-sections when manufacturing coils.

By eliminating the intermediate spaces between adjacent wires, and because the wires bake together closely at all sides, the durability of the electrical coil and, thus, the service life thereof is significantly increased by up to 50%, i.e., very significantly compared to the previously known coils manufactured from a wire having a rectangular cross-section.

The present invention is also directed to a method of manufacturing a wire with a noncircular cross-section which has two axes of different lengths which extend perpendicularly to each other, wherein the wire is composed of a metal wire and a lacquer coating with insulation and baked enamel properties surrounding the metal wire. In accordance with the invention, a lacquer-coated wire having a round cross-section is pressed by means of a rolling procedure into a cross-section having an axis ratio of at most 3:1. In accordance with a preferred embodiment, the wire is pressed so as to have an oval cross-section.

It has surprisingly been found that pressing the coated wire up to this maximum extent is possible without negatively affecting the lacquer coating, while achieving an essentially uniform coating thickness at the individual surfaces of the wire.

The method according to the present invention is preferably carried out in such a way that the lacquer-coated wire having a round cross-section is guided between two appropriately spaced-apart rolls. It is essential that the roll gap is adjusted in such a way that the ratio of the two cross-sectional axes of different lengths and extending perpendicularly to each other of 3:1 of the deformed wire is not exceeded.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

The invention will be described in more detail in connection with lacquer-coated wires whose lacquer coatings are each composed of an inner electrically insulating layer and an outer baked lacquer layer. However, instead of the lacquer coating on the metal wire having two layers, it is also possible to use a single-layer lacquer coating which simultaneously has insulating and baked lacquer properties.

Figure 1:
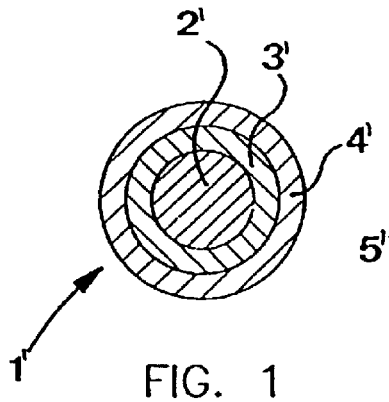
FIG. 1 is a sectional view on an enlarged scale showing a conventional coated wire having a round cross-section.
Figure 2:
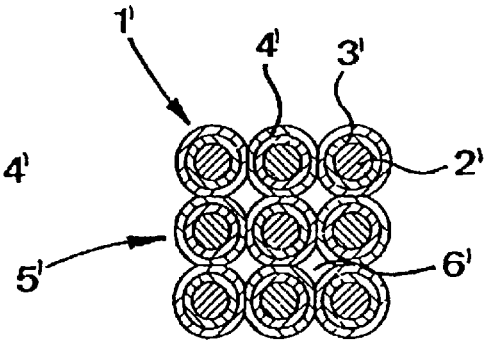
FIG. 2 is a coil manufactured from a wire according to FIG. 1.

FIG. 1 of the drawing shows a conventional lacquer-coated wire 1' having a round cross-section, wherein the metal wire 2' is surrounded by an inner electrically insulating lacquer layer 3'. Arranged on the inner lacquer layer 3' is an outer second baked lacquer layer 4' which effects a connection between the wires of electrical coils manufactured from such wires. Such a coil 5' is illustrated in FIG. 2. The lacquer-coated wires 1' which contact each other along relatively narrow contact lines are connected with each other through the baked lacquer layers. However, free intermediate spaces 6' remain between the wires 1' which lead to a reduced packing density.

Figure 3:
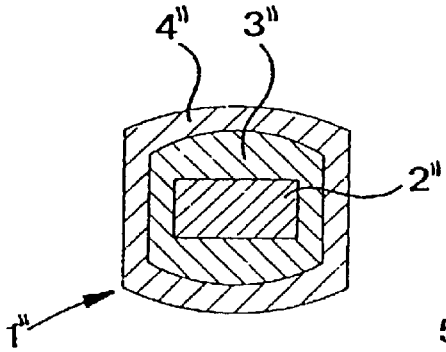
FIG. 3 is a sectional view of a conventional lacquer-coated wire having a rectangular cross-section.
Figure 4:
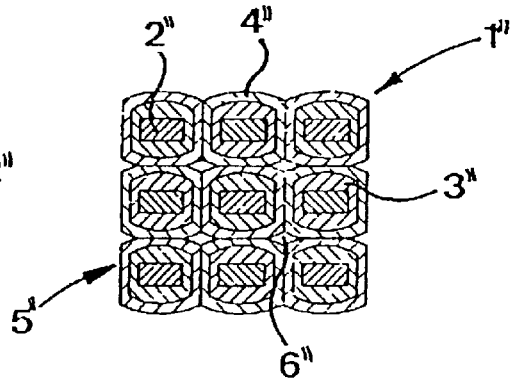
FIG. 4 is a sectional view of an electrical coil manufactured from the wire according to FIG. 3.

FIG. 3 shows a lacquer-coated wire 1" having a rectangular cross-section in accordance with the prior art. Such coated wires are conventionally manufactured by pressing or squeezing a metal wire having a round cross-section until a wire 2" having a rectangular cross-section is formed. Applied onto the deformed metal wire 2" are first an electrically insulating lacquer coating 3" and a baked lacquer coating 4" on the lacquer coating 3". Due to the lacking symmetry of the wire 2" having an essentially rectangular cross-section, these wires have coatings with nonuniform thicknesses as a result of the way in which they are manufactured, wherein the wires may have particularly at their long sides coatings 3", 4" with irregularly outwardly cambered surfaces.

Consequently, when these conventionally manufactured wires are processed into electrical coils 5", free intermediate spaces 6" are once again formed between the windings or layers of windings which lead to a reduced packing density and durability of the electrical coil.

Figure 5:
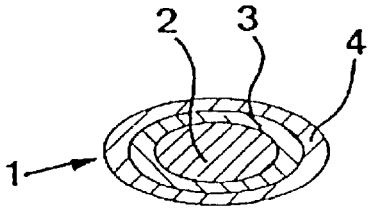
FIG. 5 is a sectional view of a wire according to the present invention having an oval cross-section.

FIG. 5 of the drawing shows a wire 1 having an oval cross-section manufactured in accordance with the present invention. The wire 1 is composed of a metal wire 2, an electrically insulating coating 3 surrounding the metal wire 2, and an outer baked lacquer layer 4 arranged on the coating 3. By continuously and gently pressing a lacquer-coated wire having a round cross-section, which because of the given symmetry can be manufactured with lacquer coatings having uniform thicknesses, into an oval cross-section having a ratio of the two cross-sectional axes of different lengths which extend perpendicularly to each other to at the most 3:1, the coated wire 1 pressed in this manner has at all sides coatings with uniformly extending thicknesses. The surface of the coating is essentially smooth. The electrically insulating coating 3 and the outer baked lacquer layer 4 each have average thicknesses of between 5 and 10 micrometers.

Figure 6:
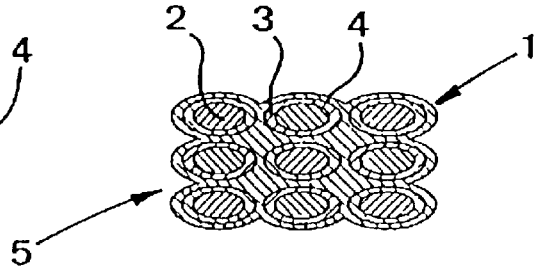
FIG. 6 is a cross-sectional view of a coil manufactured from the wire according to FIG. 5.
Figure 7:
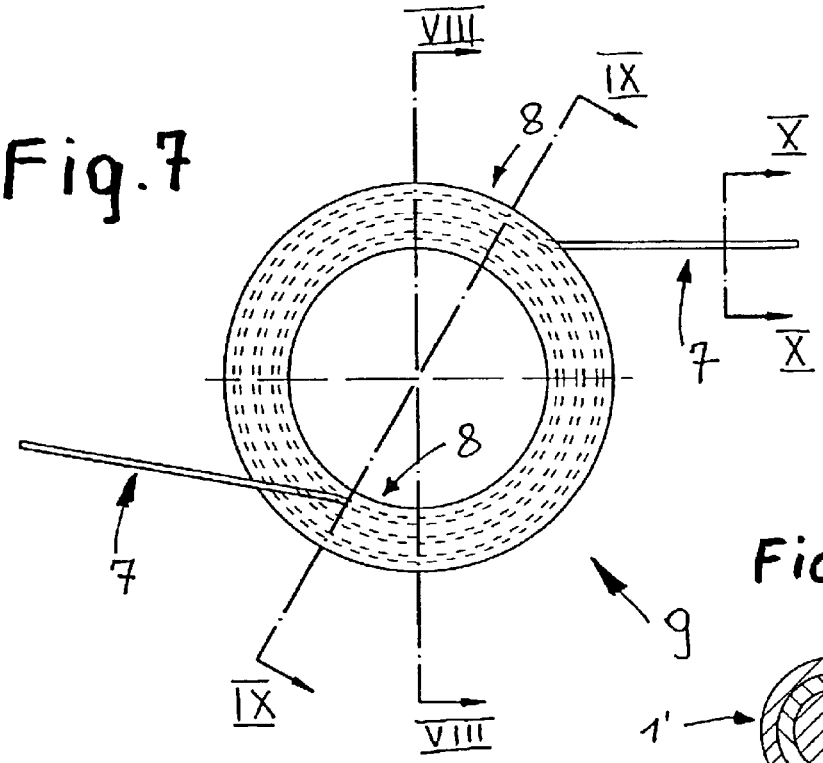
FIG. 7 is a top view of an electrical coil manufactured in accordance with the present invention.

An electrical coil 5 manufactured from wires 1 having rectangular or oval cross-sections in accordance with the present invention, as illustrated, for example, in FIG. 6, have a high packing density because the coated wires 1 are baked together at their outer baked layers 4 and are connected to one another without forming free intermediate spaces, or at least to a significant extent without forming such free intermediate spaces. This also results in a very high durability and, thus, service life of these self-supporting coils 5.

The invention makes it possible to eliminate a disadvantage of the wires having noncircular cross-sections when used in electrical coils. Such wires have the tendency to break at those locations where they extend out of the coil formation. They are much more susceptible in this regard than round wires. The reason for this susceptibility is probably the increased punctiform dynamic loads in this area against which noncircular wires have lower resistances than circular wires; however, the reasons are not completely determined yet.

Figure 10:
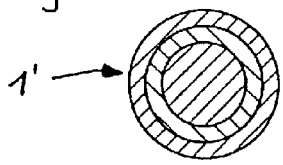
FIG. 10 is a sectional view taken along sectional line X—X of FIG. 7.
Figure 8:
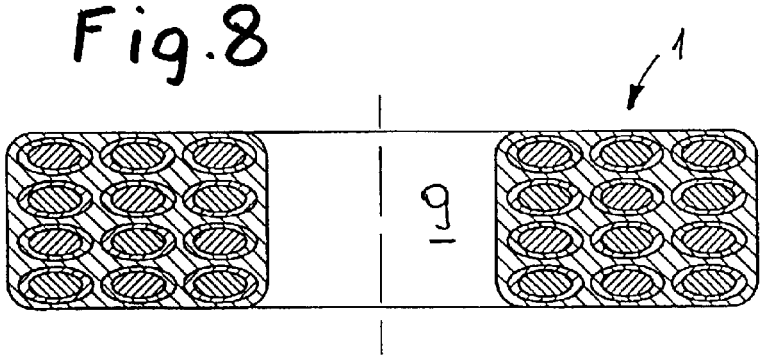
FIG. 8 is a sectional view taken along sectional line VIII—VIII of FIG. 7.
Figure 9:
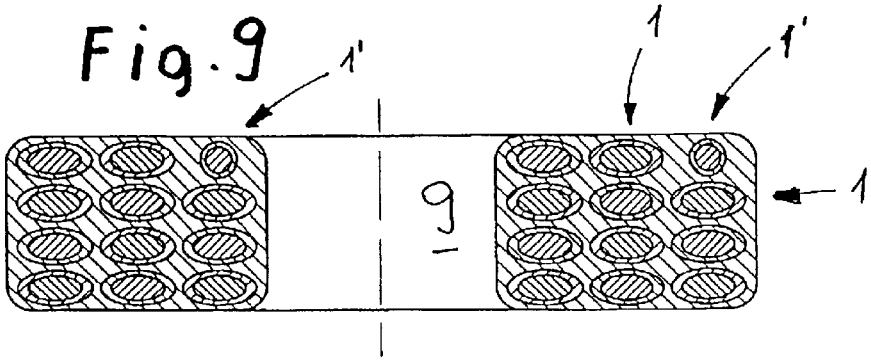
FIG. 9 is a sectional view taken along sectional line IX—IX of FIG. 7.

As illustrated in FIGS. 7 to 10, the method according to the present invention makes it possible to manufacture coils of a wire 1' which is left round as shown in FIG. 10 in the area in which it extends freely from a connection point, not shown, to the coil, along the loop 7 and along an initial portion 8 on the coil 9 which does not exceed a winding and is preferably less than half a winding, while only the actual coil body is manufactured from the wire 1 according to the present invention. In the illustrated embodiment, the transition from the round wire 1' to the noncircular wire 1 is located in the area between the sectional planes VIII—VIII and IX—IX, as seen in FIGS. 8 and 9.

This is possible because the wire is round until the coil is wound and the wire is only deformed as it is supplied to wind the coil. In noncircular wires according to the prior art, it would be completely impossible to construct the core nonuniformly over the length of the wire and to then look for and use the appropriate points of the wire. It is only the configuration according to the present invention that makes it possible to manufacture coils including their electrical supply lines in one piece but with different cross-sections over the length of the wire and to make available the best suitable cross-sectional shape for the respective location.

In actual practice, the automated manufacture of coils is carried out in such a way that the round end of the wire is grasped by the manipulator, is guided with the intended excess length to the winding point and the shaping rolls are adjusted relative to each other during this supply movement in such a way that a portion of the first winding of the coil 9 is composed of round wire 1', while the remaining length of the first winding and the additional windings are composed of noncircular wire 1. Analogously, the shaping rolls are moved apart from each other when the location of the wire has been reached where the wire is one again supposed to be round on the finished coil.

Accordingly, the present invention is directed to a coil manufactured from a wire according to the present invention in which the coil body is composed essentially of wire having a noncircular cross-section, while at least one of the supply wires or loops to the coil has a round cross-section, and a wire having a round cross-section forms part of the coil body over at most one winding, preferably at most half a winding; the invention is also directed to a method of manufacturing such a coil, wherein shaping rolls for deforming the wire are arranged between the supply reel for the round wire and the guiding device for guiding the wire to the contact point on the coil, wherein the shaping rolls are adjustable between an active position, in which they press the wire traveling through the roll gap, and an inactive position, in which the wire travels through the roll gap and remains round, and wherein the shaping rolls are in the active position when portions of the wire travel through their roll gap when the coil body is to be formed and are adjusted into the inactive position when wire portions travel through the roll gap which form a loop or a transition from coil to loop.

The invention is not limited by the embodiments described above which are presented as examples only but can be modified in various ways within the scope of protection defined by the appended patent claims.

What is claimed is:

1. A method of manufacturing a lacquer-coated wire having a noncircular cross-section with a long cross-sectional axis and a short cross-sectional axis which extend perpendicularly to each other, wherein the wire is composed of a metal wire and a lacquer coating having insulating and baked lacquer properties, the method comprising: pressing a lacquer-coated wire having a round cross-section using a rolling process into a cross-section having a ratio of the long cross-sectional axis to the short cross-sectional axis of at most 3:1; and winding the wire into a coil immediately after pressing the wire so that there is a transition from the pressed cross-section to the round cross-section in a region of a first or last winding of the coil where the wire leaves the coil.

2. The method according to claim 1, comprising pressing the wire into an oval cross-section.

3. The method according to claim 1, wherein the wire has round and noncircular sections alternatingly over the length thereof, further comprising pressing the lacquer-coated wire having a round cross-section by a rolling process along the round sections to a cross-section having a ratio of the long cross-sectional axis to the short cross-sectional axis of at most 3:1, and not pressing the wire along the round sections.

* * * * *